United States Patent [19]

Lewandowski et al.

[11] Patent Number: 5,044,020

[45] Date of Patent: Sep. 3, 1991

[54] URINAL FOR CONVENIENCE AND TRAINING OF JUVENILE MALES

[76] Inventors: David G. Lewandowski, 3030 N. 54th St., Milwaukee, Wis. 53210; Edward J. Guard, 2480 McIntosh Way, Maitland, Fla. 32751

[21] Appl. No.: 560,376

[22] Filed: Jul. 31, 1990

[51] Int. Cl.[5] ..... E03D 13/00

[52] U.S. Cl. ..... 4/301; 4/144.1; 4/460; 4/462; 4/463; 4/661; D23/296; D23/297

[58] Field of Search ..... 4/462, 301, 300.3, 308, 4/310, 312, 450–451, 456–457, 114.1, 144.1–144.5, 315, 449, 479, 460, 483, 251, 420, 300; 340/384 E; 272/1 R, 1 D; D23/29, 297; 604/347, 349

[56] References Cited

U.S. PATENT DOCUMENTS

| | | | |
|---|---|---|---|
| D. 275,600 | 9/1984 | Stairs, Jr. | 4/310 X |
| 293,275 | 2/1884 | Pullman | 4/310 |
| 706,566 | 8/1902 | Janes | 4/144.1 |
| 1,379,206 | 5/1921 | Ohara | 4/310 |
| 2,592,040 | 4/1952 | La Hue | 4/144.1 |
| 2,687,534 | 8/1954 | Johnson | 4/144.1 |
| 2,769,982 | 11/1956 | Gossett | 4/144.1 |
| 3,176,319 | 4/1965 | Mackey | 4/144.1 |
| 3,297,858 | 1/1967 | Blankenship | 4/111.1 X |
| 3,774,245 | 11/1973 | Greppi | 4/310 X |
| 3,942,196 | 3/1976 | Mills | 4/457 |
| 4,044,405 | 8/1977 | Kreiss | 4/661 |
| 4,612,676 | 9/1986 | Whitman | 4/301 X |
| 4,670,918 | 6/1987 | Juaire et al. | 4/462 X |

*Primary Examiner*—Henry K. Artis
*Attorney, Agent, or Firm*—Julian C. Renfro

[57] ABSTRACT

A urinal provided for the convenience and training of juvenile boys in accordance with this invention requires no plumbing, and comprises a support means having front and rear surfaces. The rear surface is adapted for attachment to a vertical surface, and the front surface has a receptacle-receiving lower portion. A dish shaped urine-receiving receptacle is utilized, with its lower portion having a configuration closely complementary to the lower portion of the support means. The receptacle has a full height rear wall and a front wall of abbreviated height, with the upper portions of the wall portions terminating in a generally oval front opening. The receptacle is insertable at an angle to the vertical into the lower portion of the support means, and likewise is able to be withdrawn for emptying by lifting upwardly at substantially the same angle to the vertical. The rear wall of the receptacle is adapted to be grasped for removal and emptying, with urine retained in the receptacle being able to be poured over the front wall, and into a toilet or the like. Consequently, there is no occasion for the person emptying the receptacle to grasp a portion of the receptacle that has come directly into contact with urine. A flexible splash preventing device may be used in the receptacle, and the heightwise location of the support means on the wall may be readily changed as becomes necessary.

19 Claims, 4 Drawing Sheets

URINAL FOR CONVENIENCE AND TRAINING OF JUVENILE MALES

BACKGROUND OF THE INVENTION

In the past a number of urinals have been provided for use by males, some of which have utilized plumbing, others have utilized chemical or heating means for dealing with the received urine, and still others designed to receive and contain the urine for subsequent emptying.

Urinals utilizing plumbing are to be found in mens rooms of restaurants, gasoline stations and the like, with these devices being adapted for use in the standing position, and typically being of china, porcelain or plastic construction. Many of these devices are designed and configured to afford the user a degree of privacy, and consequently they generally are of substantial weight and size.

Although many nurseries and bedrooms for young children are equipped with a potty chair for use by the child during the night, very few devices have been designed strictly for use by juvenile males, that will make it convenient for a young boy to relieve himself during the night, while in the standing position.

The Mackey U.S. Pat. No. 3,176,319 entitled "Child's Training Chair and Urinal" and issuing Apr. 6, 1965 was intended to be used by a juvenile male while in the standing position, but this device is relatively expensive, stands the risk of being turned over, and requires a substantial amount of floor space.

It was in an effort to improve upon this and other such devices that the present invention was evolved.

SUMMARY OF THE INVENTION

In accordance with this invention, a urinal has been provided for the convenience as well as the training of juvenile boys, and it advantageously requires no plumbing, thus making it ideal for use in a nursery, bedroom, or in the bathroom where the toilet may be too high for the young male.

Comparatively few devices have been provided that were designed for use by a juvenile boy in the standing position, so it is one goal of this invention to provide a urinal that is of inexpensive construction, needing no plumbing, and able to be easily emptied. Inasmuch as this new urinal is designed to be mounted on the wall, it requires a minimum of floor space, with the construction being such that it becomes highly unlikely that urine will be spilled, as was often the case when devices in the nature of potty chairs were utilized.

A urinal for juvenile boys designed in accordance with this invention comprises support means having front and rear surfaces. The rear surface is substantially flat (planar), and is adapted to be easily secured to a suit able vertical structure.

The front surface of the support means has a receptacle-receiving lower portion, with such lower portion amounting to a cavity of a generally dish-shaped configuration. Fitting closely inside is a dish-shaped urine-receiving receptacle of a configuration closely complimentary to the dish-shaped lower portion of the support means.

The urine-receiving receptacle has a full height rear wall and a front wall of abbreviated height, with side walls possessing substantial curvature extending smoothly between the front and rear walls, and with the upper portions of the wall portions terminating in a generally oval front opening. We preferably utilize a mating lip or flange around the entire upper edge of the opening in the support means, that forms a uniform and stable support for the urine receptacle.

Importantly, the lowest portion of the receptacle is configured at a radius providing maximum capacity for urine, while not being so great as to prevent immersion of the urine-receiving portion of the receptacle in a toilet of standard configuration, to enable the ready cleaning of the receptacle without the parent or other such person having to handle the interior portions of the receptacle.

The cavity defined in the lower portion of the support means resides at an angle to the vertical, such that the urine receptacle is insertable at an angle into the lower portion of the support means. Likewise, the receptacle is able to be withdrawn for emptying by lifting it upwardly at an angle to the vertical. At the time of emptying, the urine receptacle is adapted to be grasped by its rear right and left flange that have been designed as grasping areas, with the urine caught and retained in the receptacle being poured over the front wall of abbreviated height during the emptying procedure. Consequently, there is no occasion for the person emptying the receptacle to grasp a portion of the receptacle that has come into direct contact with the urine.

The advantages of this construction are several, with a principal advantage being that the spilling of the contents of the receptacle on the floor during use or during emptying is quite unlikely. Our device clearly serves to help train a juvenile boy in the use of the type of urinal he will later contact in public places, such as in restaurants, filling stations and the like. It is to be noted that our novel urinal is also designed to look similar to the generally accepted designs of the modern public urinal.

Thus, our novel urinal serves as a teaching aid for a juvenile boy, while at the same time being of low or modest cost, and being safely mounted on a wall where it will be stably mounted and require a minimum of the floor space. The cost of plumbing is completely avoided.

It is therefore a principal object of our invention to provide a low cost urinal serving to help train a juvenile boy in the use of the urinals he will later find in mens rooms of public places.

It is another important object of our invention to provide a highly effective urinal serving to help train a juvenile boy in the use of the urinals, able to be installed in a wide variety of locations, yet requiring no installation of plumbing.

It is still another object of our invention to provide a low cost urinal adapted to be readily affixed to the wall of a bedroom or nursery, to be of considerable convenience to a juvenile boy in that he will not need to try to find the bathroom during the night, but rather he will be able to readily find a suitable urine-receiving device at a predictable location in his nursery or bedroom.

It is yet still another object of our invention to provide a urinal having a support means equipped with a receptacle-receiving lower portion adapted to receive a urine receptacle that will be stably held during use, that resists spillage yet is able to be dumped in a most convenient manner.

Yet still another object of our invention is to provide a urinal for a juvenile male that is easy to fabricate from plastic and easy to clean, involving no holes nor plumbing nor any mechanical fasteners to corrode or leak.

Yet another object of our invention is the provision of a three piece assembly whose components can be easily injection molded out of durable thermoformed plastic, of any selected color.

Yet another object of our invention is the provision of a novel urinal for use by a juvenile male that can be readily attached to a wide range of vertical surfaces by means of screws, which can be easily placed at the appropriate height for the small male child, with the arrangement being such that the urinal can be easily and gradually raised as the child grows taller.

These and other objects, features and advantages of this invention will be discussed at greater length hereinafter.

DETAILED DESCRIPTION

Figure 1:
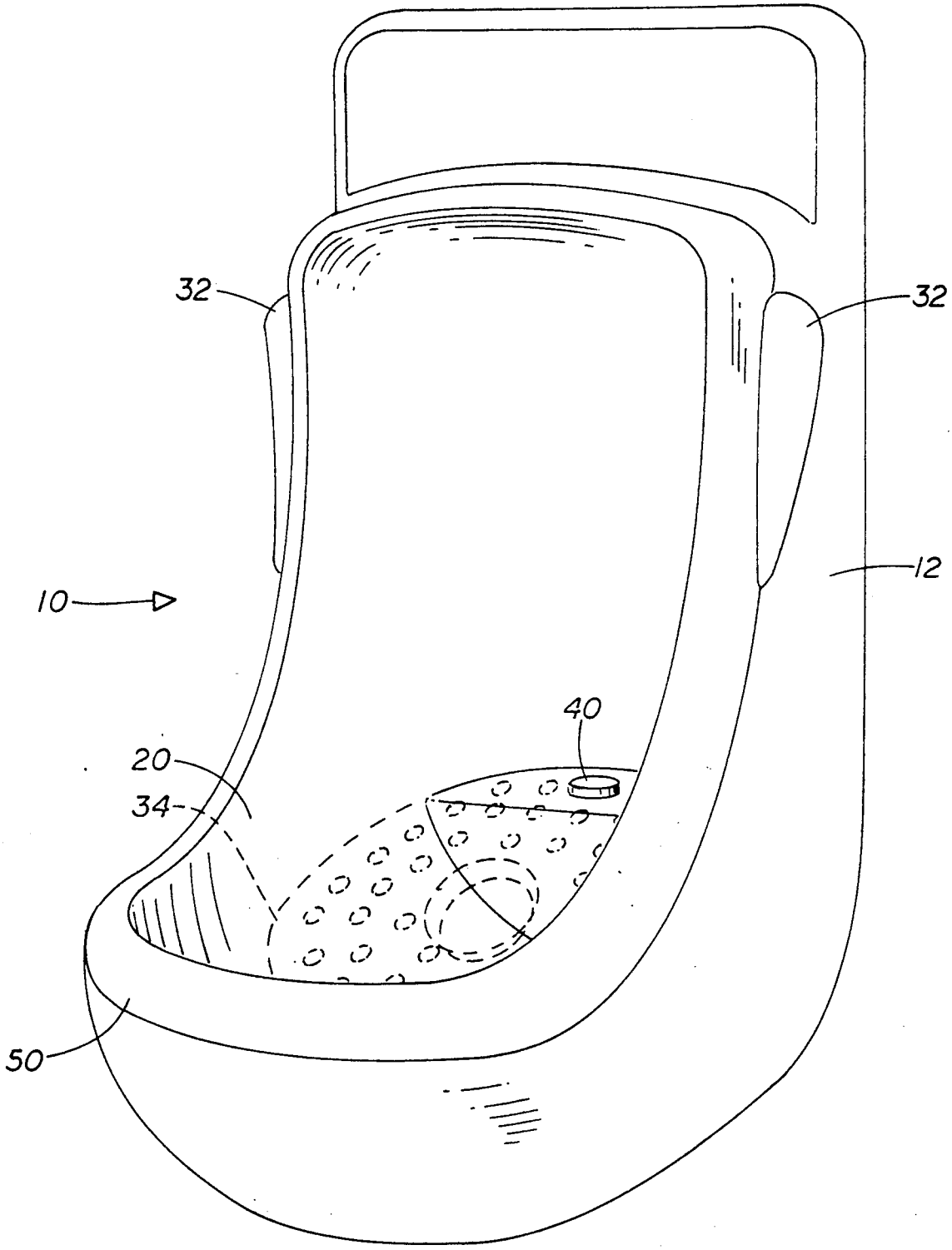
FIG. 1 is a perspective view of our novel urinal for the young male, revealing how the removable urine-receiving receptacle fits snugly in the support means attached to a suitable vertical surface.

Turning to FIG. 1, it will there be noted that we have shown a urinal 10 in accordance with this invention mounted on a vertical surface in a bedroom or nursery in such a position that it can be readily used by a juvenile boy. Our novel urinal involves a support means 12 removably affixed to a wall or to any convenient, substantial structure, which support means is configured to receive and support a receptacle 20. Because the instant urinal is secured to a specific vertical surface in a bedroom, it will always be in a predictable location, such that the young male occupant or occupants of the bedroom will always be able to find the urinal during the night. This arrangement makes plumbing unnecessary and also eliminates the use of conventional potty chair that occupies a tangible amount of floor space, and that can be easily kicked over during the night by someone walking through the bedroom.

Figure 2:
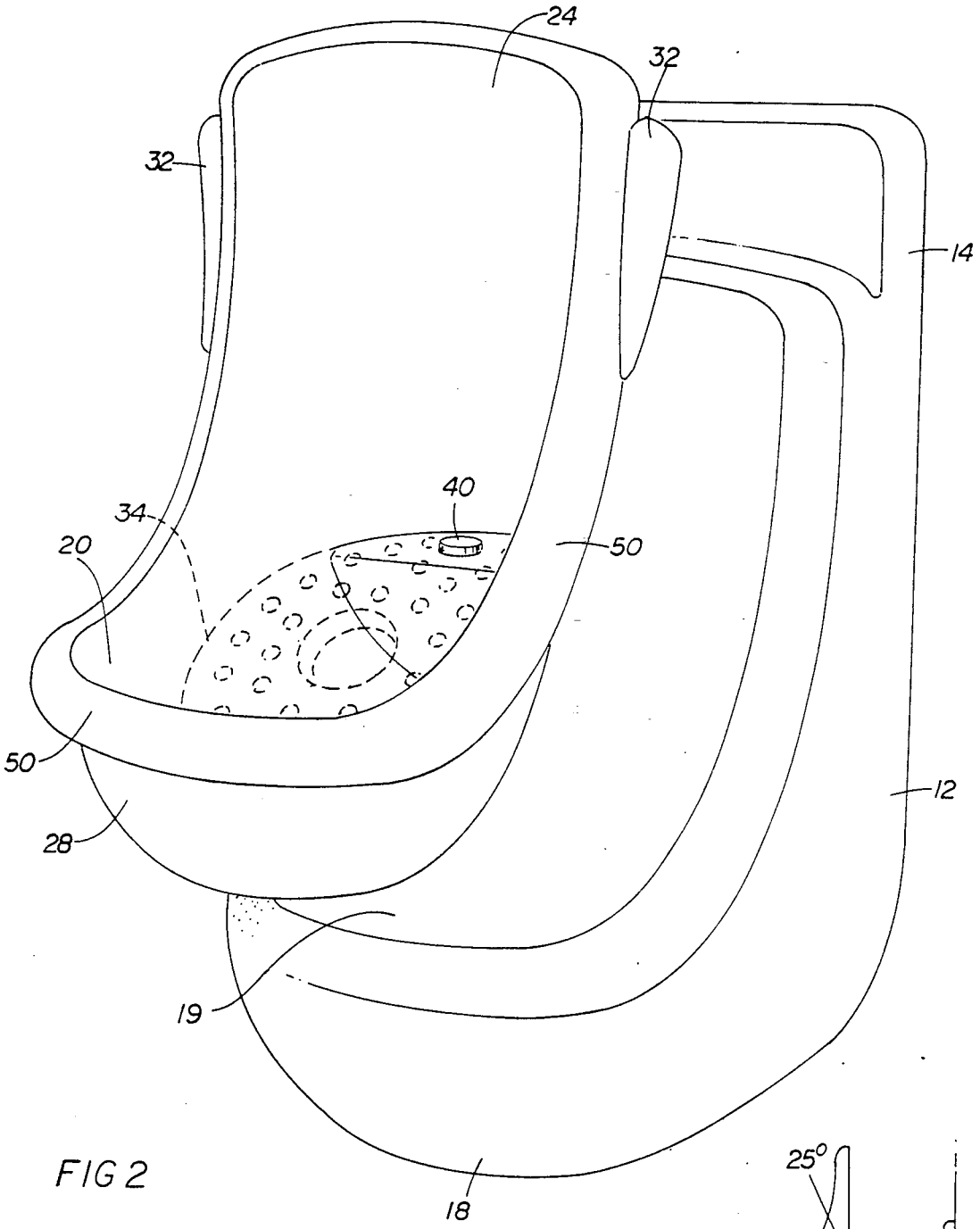
FIG. 2 is a view similar to FIG. 1, but showing that the urine-receiving receptacle must be lifted out of the support means at an angle, rather than directly upward.

With reference to FIG. 2, it will be noted that support means 12 has front and rear surfaces, with rear surface 14 being understood to be substantially flat (planar), and being adapted for attachment to a wall.

Figure 3:
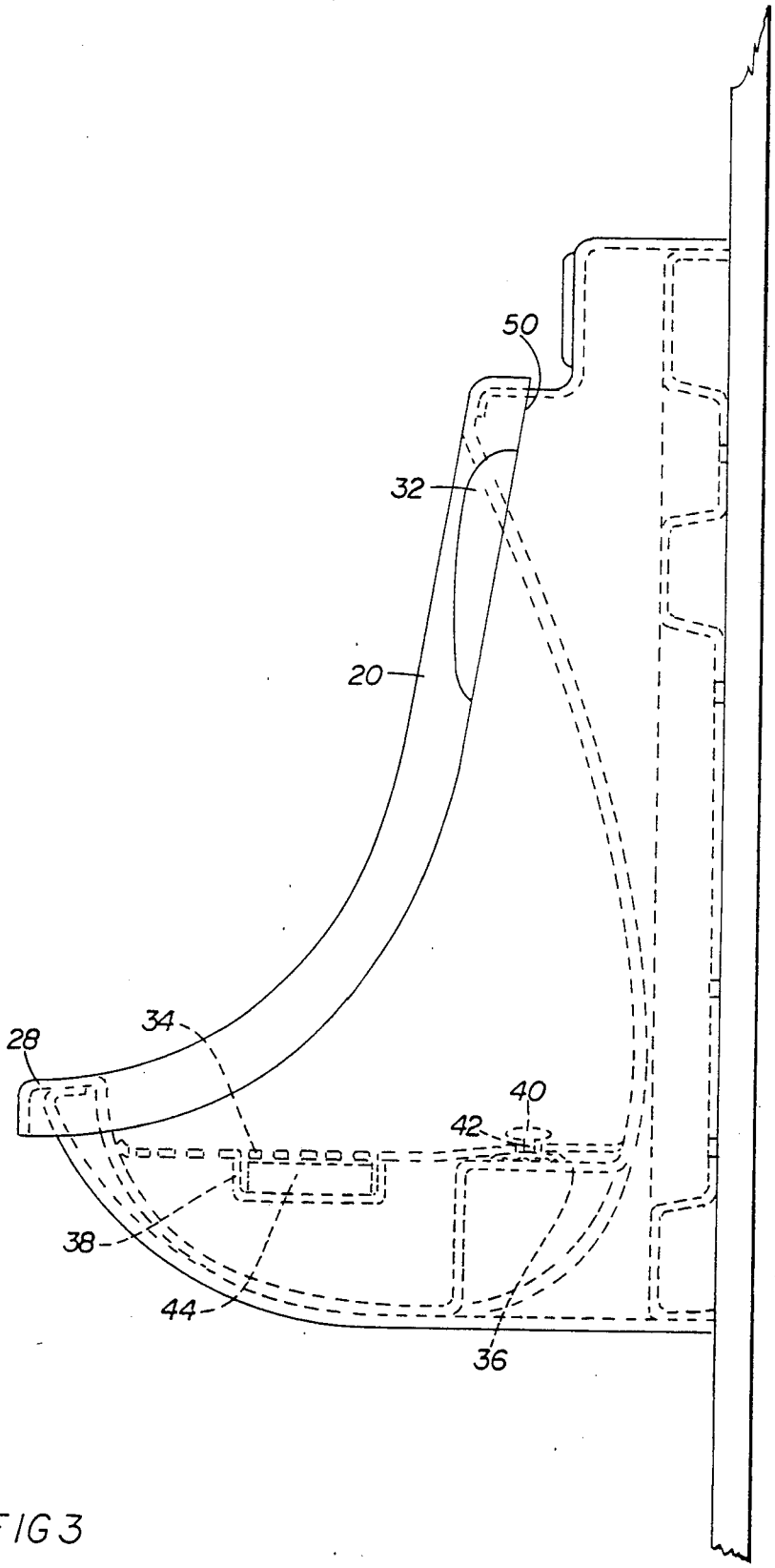
FIG. 3 is a side view taken of our novel urine-receiving receptacle, with dashed lines utilized to connote certain internal construction.
Figure 3A:
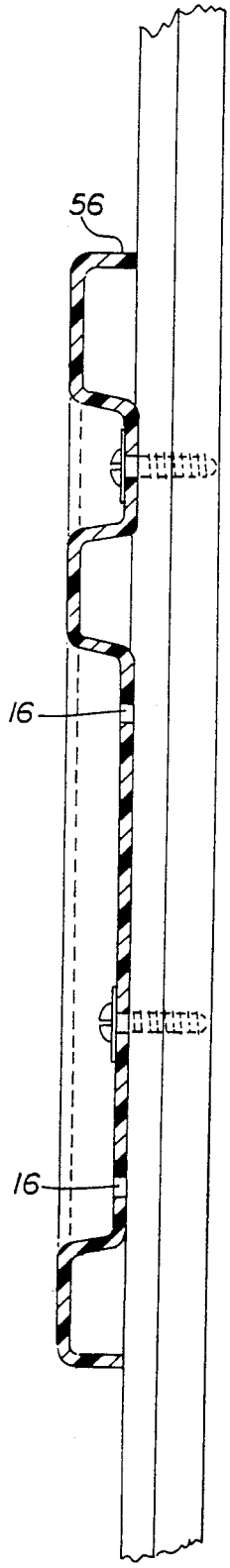
FIG. 3*a* is a cross-sectional view relatable to the support means portion of FIG. 3, and revealing the preferred manner in which our novel urinal is to be supported from the vertical surface.
Figure 4:
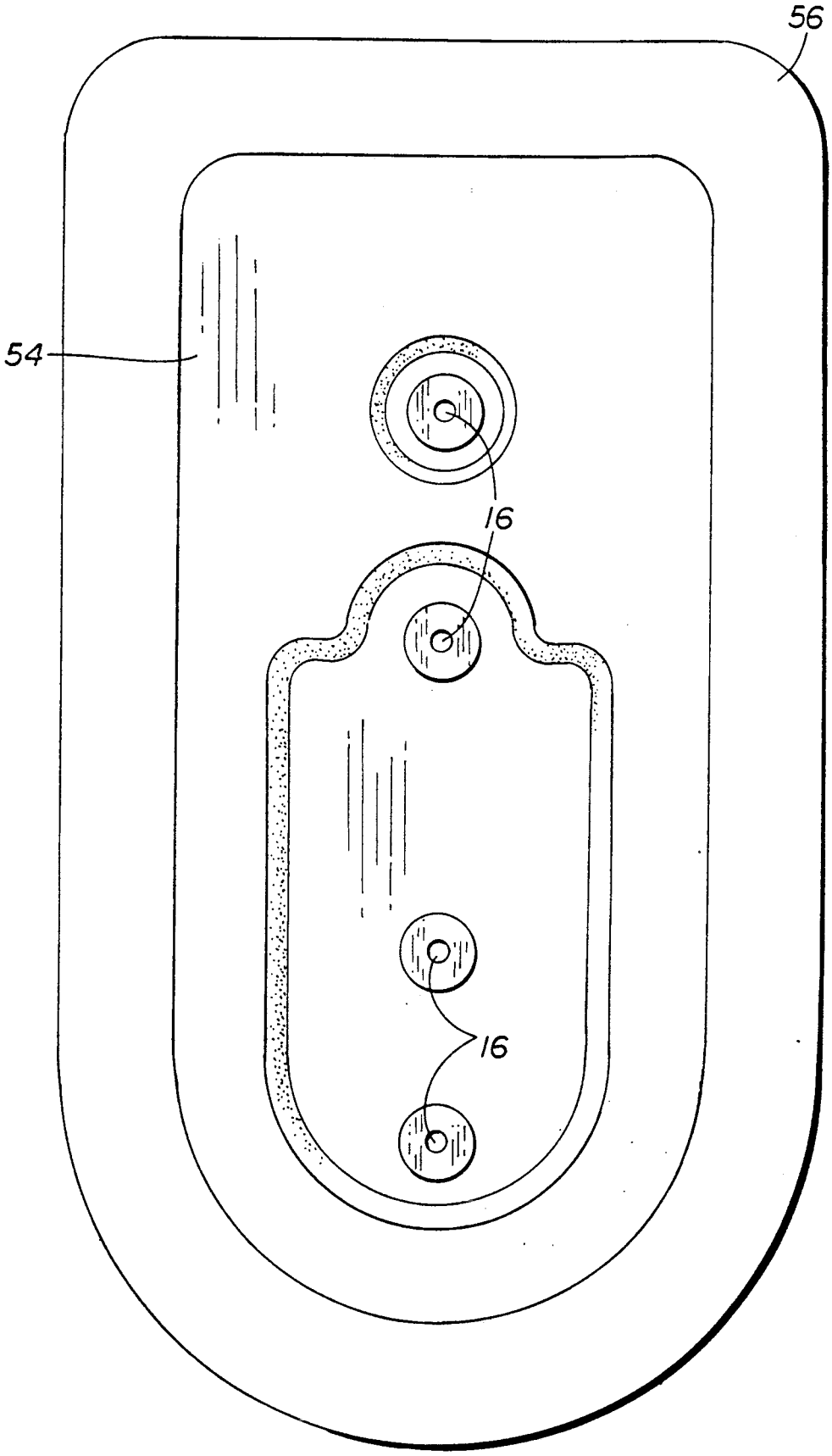
FIG. 4 is a frontal view of the back plate for the support means.

Turning for the moment to FIGS. 3*a* and 4, it will be seen that a plurality of mounting holes 16 is provided in a spaced vertical array on the interior rear surface 54 of our device, so that the device may be affixed to a wall of the bedroom of a juvenile male by the use of screws, or other suitable fasteners. More details of the preferred mounting arrangement will be discussed hereinafter.

As will best be seen in FIG. 2, the front surface of the support means 12 has a receptacle-receiving lower portion 18, with such lower portion having a cavity 19 of a generally dish-shaped configuration.

The dish-shaped urine-receiving receptacle 20 is of a configuration closely complementary to the dish-shaped receptacle-receiving lower portion 18 provided in accordance with this invention in the lower front portion of the support means 12. The receptacle 20 is designed and adapted to be snugly received in the cavity 19 provided in the front portion of the support means 12. The urine-receiving receptacle 20 has a full height rear wall 24 and a front wall 28 of abbreviated height, as depicted in FIG. 2. The side walls possess substantial curvature extending between the rear and front walls of the receptacle. The rear wall 24 preferably has some curvature in a left-right sense, to lessen the likelihood of splashing.

Importantly, the lowest portion 30 of the urine-receiving receptacle 20 has substantial curvature, as depicted in FIGS. 2 and 3. The radius of curvature is such as to permit immersion of the lowest portion of the receptacle in a toilet for cleaning, without substantially compromising the capacity of the receptacle for retaining urine. We have found that a radius of curvature of approximately four inches is usually ideal, for the lowest portion 30 of the receptacle 20 can still be fitted inside the bowl of most toilets during the emptying and cleaning procedure, without compromising the desirably large liquid capacity.

Figure 2A:
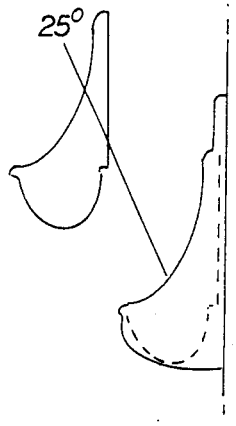
FIG. 2*a* is a showing to a small scale of the specific manner in which the receptacle is to be removed from its support means that in turn is supported from the vertical surface.

Returning to a consideration of the support means 12, the upper portions of the wall portions terminate in a generally oval front opening, with the lower portion 18 of the support means 12 being disposed at an angle to the vertical. The urine-receiving receptacle 20 has a like angular external configuration. The receptacle is insertable at an angle corresponding to the angle of the lower portion 18 of the support means 12, into the cavity 19 formed in the lower portion 18 of the support means; note FIGS. 2 and 2*a*.

The urine-receiving receptacle 20 is able to be readily withdrawn from the support means 12 for emptying by lifting it upwardly at an angle to the vertical, with this angle corresponding to the angle in which the cavity in the support means is configured. Note in FIG. 2*a* we prefer an angle of 25 degrees to the vertical, but quite obviously, we are not to be limited to this. Advantageously, in emptying the receptacle 20, the user may grasp the full height rear wall 24 at the right and left sides, lift the receptacle out of the cavity 19 located in the support means, and then pour the trapped urine over the front wall 28, into the toilet. It is therefore entirely unnecessary for the person emptying the urinal to come into contact with the urine. As an option we can place handles or "ears" 32 on the sides of the receptacle, to expedite the removal of the receptacle during the emptying procedure; note FIGS. 1 and 2.

Most importantly, and as previously mentioned, the left-right dimension of the urine-receiving receptacle 20 is such as to permit substantially the entire receptacle to be inserted in a conventional toilet for cleaning, with the flushing of the toilet at the time of such immersion enabling a very adequate washing of the receptacle. Maximum capacity of the urine-receiving portion of the receptacle is assured, as previously mentioned, by the proper selection of the radius used for configuring the urine-receiving portion.

Also importantly, the urine-receiving receptacle 20 is designed to fit into the cavity or aperture 19 of the support means 12 quite snugly, and that factor, in addition to the low center of gravity of the urine-receiving receptacle, usually makes any latching means on the support means 12 unnecessary.

The low center of gravity of the receptacle 20 provides the additional advantage of causing the receptacle to fall backward into the support means should the young male pull the rear wall forwardly in an aborted effort to remove the receptacle, and then release the rear wall when he realizes he is unable to remove the receptacle from the support means by only a forward pull.

With continued reference to FIG. 3, it is to be noted that we may optionally use a splash preventing device 34, which may be used either with or without a deodorant cake. The device 34 is preferably of flexible plastic, and anchored at its rear portion upon a shelf-like member 36, preferably created at the lower rear portion of the receptacle 20 at the time the receptacle is being molded. The splash preventing device 34 is visible in FIGS. 1 and 2, with dashed lines being utilized in depicting device 34 in these latter named figures, in order to connote its optional use.

The splash preventing device 34 is generally circular, and although of flexible plastic, it nevertheless tends to maintain its shape. The device 34 has many holes therein, with a receptacle 38 for the deodorant cake being located in approximately the middle of the device 34. We preferably utilize an upstanding button-like member 40 on the upper surface of the shelf 36, to serve as a convenient anchor or locating device for the splash preventing device 34. We create a hole 42 in the rear portion of the device 34, that is somewhat larger than the rest of the holes in the device 34, but small enough to require a degree of stretching of the plastic in order that the hole 42 can be fitted over the button 40. This arrangement enables the user to readily install the splash preventing device in a very convenient manner upon the shelf 36, merely by stretching the hole 42 a bit, in order to fit it over the upstanding button member 40.

The splash preventing device 34 is to be positioned such as indicated in FIGS. 1 through 3. Because of the anchoring of the splash preventing member 34 from the rear shelf 36 of the urine receptacle 20, it automatically hinges under the influence of gravity during the urine emptying procedure. By hinging out of the way when the parent tilts the receptacle over the toilet at a suitable pour angle, the device 34 permits an uninhibited flow of urine over the front wall 28 of the receptacle. The securing button 40 thus prevents loss or displacement of the splash preventing device when the urine is being emptied from the urine receptacle, and during the time that the receptacle is thereafter being rinsed. After replacement of the urine receptacle 20 in the receptacle-receiving lower portion 18 of support means 12, the splash preventing device 34 returns under the influence of gravity to its normal position depicted in FIGS. 1 through 3.

As mentioned hereinabove, the flexible splash preventing device 34 may be configured to receive a cake of deodorant material 44, which is located in the receptacle 38. In order that the deodorant material may be replenished when from time to time necessary, we typically provide a hinge at one peripheral location on the cup or receptacle 38, and a latch at the opposite side of the receptacle. Thus, to refill the receptacle 38, the user opens the latch, pivots the device 38 to the open position, inserts a new deodorant cake, and then relatches the receptacle. Advantageously, the cup or receptacle used for housing the deodorant cake will not in any appreciable manner impede the cleaning action obtained at such time as the urine receiving receptacle has been immersed in a toilet and the toilet flushed.

As is obvious, the splash preventing device 34 is readily replaceable, as may become necessary from time to time.

As is visible in FIGS. 1 through 3, we prefer to utilize a type of flange 50 extending entirely around the open upper portion of the urine-receiving receptacle 20, to prevent it from dropping too far down into the aperture or cavity 19 of the support means 12. The flange 50 also serves to provide an additional amount of strength to the receptacle 20, and to prevent urine from entering the cavity 19, from which the urine might be difficult or inconvenient to remove.

We prefer to make the supporting means 12 for the urine receptacle 20 from thin walled material, preferably plastic such as polyethylene or polypropylene, because of its high resilience, low cost and non-corrosive characteristics. The lower, receptacle-receiving portion 18 of the support means 12 can be generally circular. For example, a circular configuration defined by a $4\frac{3}{4}$ inch radius was appropriate in one particular embodiment. In such instance, the urine receptacle 20 able to be fitted into the cavity 19 was found to be able to hold 64 ounces of urinary waste.

As previously indicated, we prefer to have the entire inner peripheral edge of the receptacle-receiving portion 18 of the support means 12 configured to receive the receptacle 20 snugly, so as to form a non-apparent liftout relationship between the members 12 and 20. Because of this preferred arrangement, it is unlikely that a young child will be tempted to try to remove the urine receptacle from the support means, thus effectively preventing spillage of the contents about the floor of the bedroom or other such location. The snug non-apparent liftout feature also prevents the receptacle from being dislodged by an accidental contact with the support means.

It is to be realized that in FIGS. 3*a* and 4, we reveal certain additional details of the support means 12, including for example the mounting locations 16 on the interior rear surface 54 of the wall attachment mounting plate 56. Wall fasteners are utilized in securing the support means to the selected wall, or to any suitable vertical surface. The wall attachment mounting plate 56 is typically molded separate from the part of the support means conspicuously visible in FIGS. 1 and 2, but then it is bonded permanently, by means of a liquid chemical bonding agent, to the rear side of the support means 12.

As was earlier noted with respect to FIG. 4, we typically provide four holes 16 in the rear surface 54, with the first and third holes from the top being the same distance apart as second and fourth holes, or in other words, the four holes 16 represent two pairs of holes. Only two screws are needed for the normal mounting, so at the time of the original installation, screws can be utilized in only the first and third holes. These screws are then tightened into corresponding holes in the wall or other suitable vertical surface.

Then, as the boy grows, the height of the urinal can be adjusted upwardly as appropriate, using the same two wall holes. By now inserting the pair of screws in the second pair of holes, that is, the second and fourth holes, the desired height change of the urinal has been readily achieved. As is obvious, as long as the pairs of holes utilized in the vertical array on the rear surface 54 are spaced apart like amounts, height changes of the urinal can be readily brought about. Also, more than two pairs of holes can be used in the vertical array in the event more height changes are desired, or as an alternative, elongate holes or slots may be used instead of the round holes depicted in FIG. 4, in order to make readily possible a wide range of height changes.

As previously mentioned, we prefer to rigidly and permanently secure the wall attachment mounting plate 56 (with its interior rear surface 54) behind the support means 12 during one phase of manufacture, so as to provide a desirable amount of stiffness to the means we use for supporting the urine receptacle. To that end, we smoothly contour the peripheral edges of the mounting plate 56, and carefully shape the rearmost peripheral edges of the support means 12, so that an effective and complete joinder of the support means to the back plate 56 can be achieved.

As by now should be apparent, our novel urinal assembly is made up of several basic units; the wall attachment mounting plate 56, as seen in FIG. 4; the support means 12 for the urine receptacle, to the rear side of which is permanently bonded the mounting plate 56; and the urine receptacle 20, as seen in FIGS. 2 and 3. The urine receptacle fits snugly inside the support receptacle and is held removably in place by the outer matching flanges of each unit, assisted by the pull of gravity. We prefer to vacuum form or injection mold the support means 12 as well as the urine receptacle 20.

Our advantageous design will permit use by a juvenile male standing either directly in front, or else somewhat to one side. Our device can easily be removed from the wall of the child's bedroom, and taken to the house of a babysitter, or on trips, where it can readily be reinstalled at each new resting place. The receptacle can readily be rinsed as needed, either in a lavatory or a toilet.

We prefer to utilize injection molding techniques in the construction of the urinal in accordance with this invention, although we obviously are not to be limited to such. We may use any of several commercially available plastics, but we prefer to use ABS, or else polyethylene, polypropylene or polycarbonate.

We claim:

1. A urinal provided for the convenience and training of juvenile boys and having no plumbing, comprising a support means having front and rear surfaces, said rear surface being adapted for attachment to a vertical surface, and said front surface having an upper portion as well as a receptacle-receiving lower portion, a dish shaped urine-receiving lower portion, a dish shaped urine-receiving receptacle of a configuration closely complementary to the lower portion of said support means, said receptacle having a full height rear wall extending up to a lesser height than said upper portion of said support means, as well as a front wall of abbreviated height, the upper portions of said wall portions terminating in a generally oval front opening, said receptacle being insertable at an angle into said lower portion of said support means into a retention position, and likewise being able to be withdrawn for emptying by lifting upwardly at an angle to the vertical, the rear wall of said receptacle adapted to be grasped for removal and emptying, with urine retained in said receptacle being able to be poured over said front wall, and into a toilet or the like, with there consequently being no occasion for the person emptying the receptacle to grasp a portion of the receptacle that has come directly into contact with urine.

2. The urinal as recited in claim 1 in which the lower portion of said support means, and the lower portion of said receptacle are each configured at approximately a 25° angle to the vertical.

3. The urinal as recited in claim 1 in which said support means has side edges contoured to enable said receptacle to be snugly fitted into the retention position.

4. A urinal provided for the convenience and training of juvenile boys and having no plumbing, comprising a support means having front and rear surfaces, said rear surface being substantially planar and adapted for attachment to a wall, and said front surface having an upper portion as well as a receptacle-receiving lower portion, a dish shaped urine-receiving receptacle of a configuration closely complementary to the lower portion of said support means, said receptacle having a full height rear wall extending up to a lesser height than said upper portion of said support means, as well as a front wall of abbreviated height, the upper portions of said wall portions terminating in a generally oval front opening, said lower portion of said support means being disposed at an angle to the vertical, said receptacle being insertable at an angle into said lower portion of said support means into a retention position, and likewise being able to be withdrawn for emptying by lifting upwardly at an angle to the vertical, the rear wall of said receptacle adapted to be grasped for removal and emptying, with urine retained in said receptacle being able to be poured over said front wall, and into a toilet or the like, with there consequently being no occasion for the person emptying the receptacle to grasp a portion of the receptacle that has come directly into contact with urine.

5. The urinal as recited in claim 4 in which the lower portion of said support means, and the lower portion of said receptacle are each configured at approximately a 25° angle to the vertical.

6. The urinal as recited in claim 4 in which said receptacle has a flexible splash prevention device.

7. The urinal as recited in claim 6 in which said splash prevention device is readily replaceable.

8. The urinal as recited in claim 6 in which said splash prevention device supports a deodorant cake.

9. The urinal as recited in claim 4 in which said support means has side edges contoured to enable said receptacle to be snugly fitted into the retention position.

10. The urinal as defined in claim 4 in which said support means is made from two separate pieces, a back member and a front portion, that are secured together during manufacture.

11. The urinal as defined in claim 4 in which said flat back member has a plurality of mounting holes, enabling the user to readily adjust the height of said support means, and consequently the height at which said urine receptacle is supported.

12. A urinal provided for the convenience and training of juvenile boys and having no plumbing, comprising a support means having front and rear surfaces, said rear surface being substantially planar and being adapted for attachment to a wall, and said front surface having an upper portion as well as a receptacle-receiving lower portion said lower portion being in a generally dish shaped configuration, a dish shaped urine-receiving receptacle of a configuration closely complementary to said dish shaped lower portion of said support means, said receptacle having a full height rear wall extending up to a lesser height than said upper portion of said support means, as well as a front wall of abbreviated height, with sidewalls possessing substantial curvature extending smoothly between said rear and front walls, the upper portions of said wall portions terminating in a generally oval front opening, said lower portion of said support means being disposed at an angle to the vertical, with said receptacle likewise having an angular external configuration, said receptacle being insertable at an angle into said lower portion of said support means into a retention position, and likewise being able to be withdrawn for emptying by lifting upwardly at an angle to the vertical, the rear wall of said receptacle adapted to be grasped for removal and emptying, with urine retained in said receptacle being able to be poured over said front wall, and into a toilet or the like, with there consequently being no occasion for the person emptying the receptacle to grasp a portion of the receptacle that has come directly into contact with urine.

13. The urinal as defined in claim 12 in which the lower portion of said support means, and the lower portion of said receptacle are each configured at approximately a 25 ° angle to the vertical.

14. The urinal as recited in claim 12 in which said support means has side edges contoured to enable said receptacle to be snugly fitted into the retention position.

15. The urinal as defined in claim 12 in which said receptacle has a flexible splash prevention device.

16. The urinal as recited in claim 15 in which said splash prevention device is readily replaceable.

17. The urinal as recited in claim 15 in which said splash prevention device supports a deodorant cake.

18. The urinal as defined in claim 12 in which said support means is made from two separate pieces, a back member and a front portion, that are secured together during manufacture.

19. The urinal as defined in claim 12 in which said flat back member has a plurality of mounting holes, enabling the user to readily adjust the height of said support means, and consequently the height at which said urine receptacle is supported.

* * * * *